United States Patent [19]

LaConte

[11] 4,270,782

[45] Jun. 2, 1981

[54] DIRECTIONAL RELEASE TOGGLE LATCH

[75] Inventor: Richard J. LaConte, Auburn, Wash.

[73] Assignee: The Boeing Company, Seattle, Wash.

[21] Appl. No.: 72,385

[22] Filed: Sep. 4, 1979

[51] Int. Cl.[3] ..... E05C 19/18

[52] U.S. Cl. ..... 292/288

[58] Field of Search ..... 292/40, 50, 52, 258, 292/259, 288

[56] References Cited

U.S. PATENT DOCUMENTS

| | | | |
|---|---|---|---|
| 977,491 | 12/1910 | Vigdal | 292/40 X |
| 1,224,212 | 5/1917 | Rewell | 292/259 X |
| 3,177,022 | 4/1965 | McKee et al. | 292/50 |

*Primary Examiner*—Richard E. Moore

*Attorney, Agent, or Firm*—Morris A. Case; Bernard A. Donahue

[57] ABSTRACT

An elongated latch body has an eyelet on one end, and an open ended clevis shape on the other end. A pair of cooperating, laterally extending, and partially overlapping linkages are pivotally mounted near the open end of the clevis part of the latch body and a U-shaped rocker arm, also mounted within the clevis part of the latch body, controls rotational movement of the linkages.

7 Claims, 8 Drawing Figures

Fig. 1
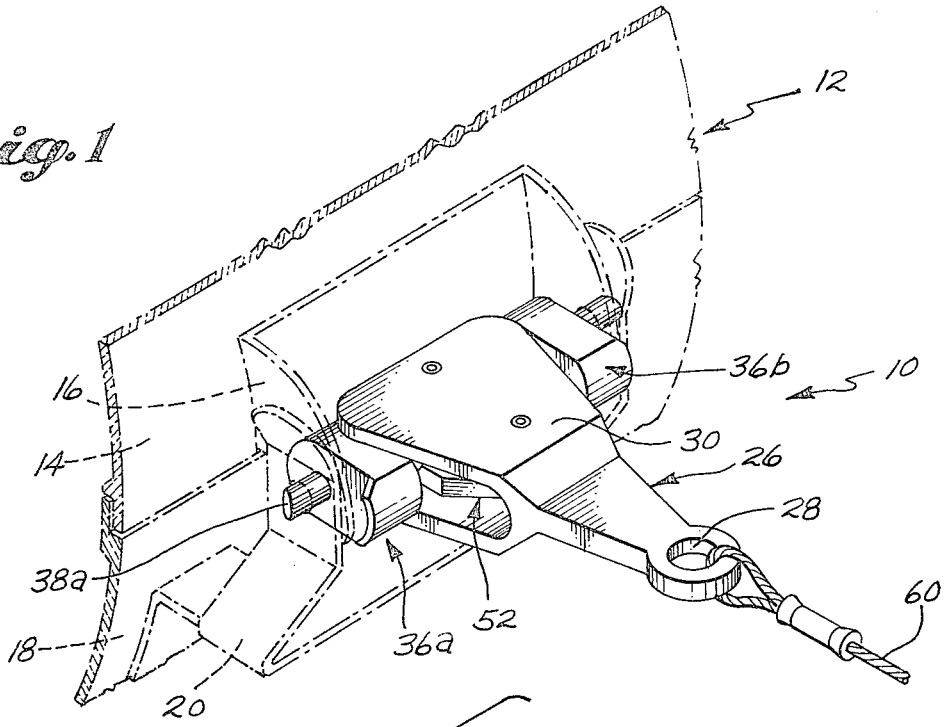
Fig. 2
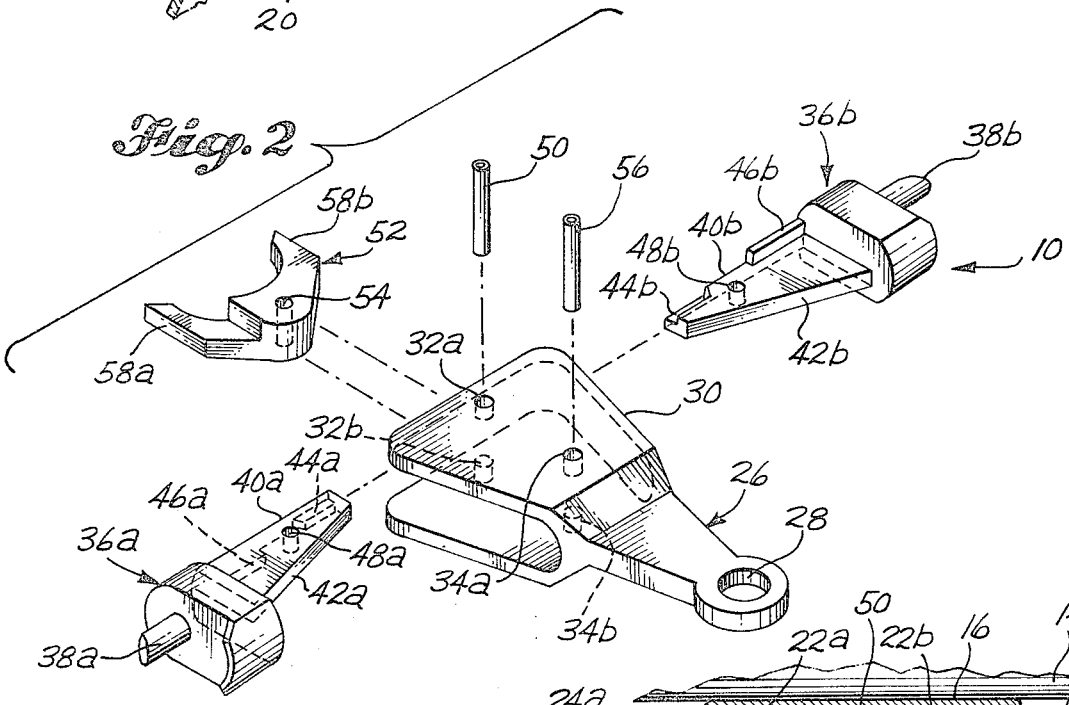
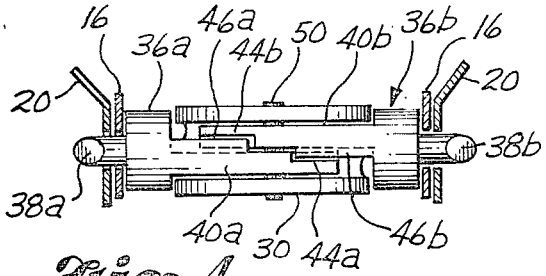
Fig. 4
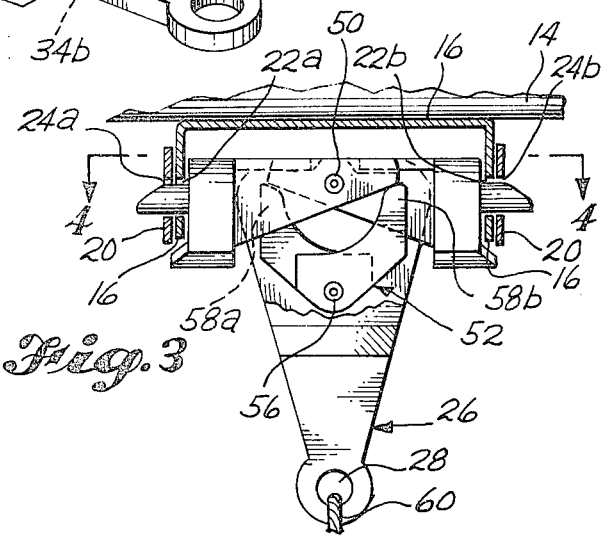
Fig. 3

DIRECTIONAL RELEASE TOGGLE LATCH

BACKGROUND OF THE INVENTION

An over center toggle latch that fits into interlocking brackets, located on two halves of a compartment, is often used to lock the two halves of the compartment together while permitting the latch to be pulled completely free from the brackets to allow the compartment to open. One difficulty with an over center toggle arrangement is that any pull on the latch, in a direction away from the over centering, will release the latch. It was found that a directional release toggle latch will prevent release when a force is applied at an angle at or near perpendicular to the toggle latch while permitting release when force is applied at somewhat of an angle from perpendicular.

SUMMARY OF THE INVENTION

An enlongated latch body is clevis shaped at one end. A pair of cooperating, partially overlapping linkages extend in a transverse direction and are mounted inside the clevis part of the latch body in a manner to permit rotation in a direction away from the body. A U-shaped rocker arm is pivotally mounted within the clevis part of the latch body, and extends to control rotation of the linkages, depending upon the angle upon which the latch body is positioned with respect to the linkages.

It is an object of this invention to provide a directional release toggle latch.

DESCRIPTION OF THE DRAWINGS

FIG. 1 shows a perspective view of the directional toggle mechanism of this invention, locked in place.

FIG. 2 shows an exploded perspective view of the toggle mechanism of FIG. 1.

FIG. 3 shows a side elevational view, partially in section, of the locked directional toggle mechanism of FIG. 1.

FIG. 4 shows a view taken along the lines of 4—4 of FIG. 3.

DETAILED DESCRIPTION

Figure 5:
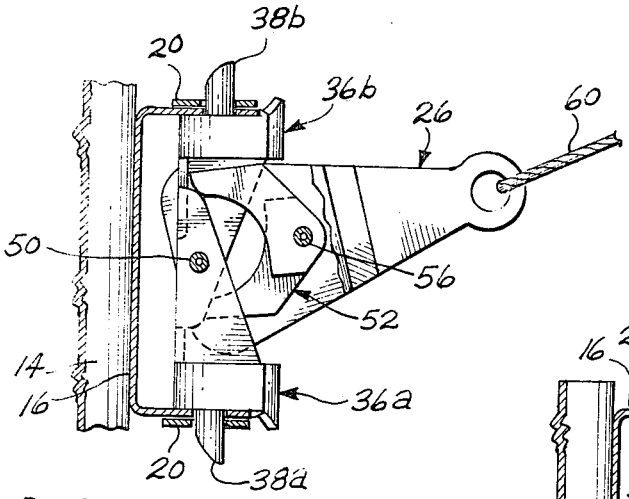
FIGS. 5, 6 and 7 show side view sequence, partially in section, of the toggle mechanism locked, starting to unlock, and unlocked and broken free.

A directional release toggle latch 10 is shown joined to, and locking together, a segmented compartment 12. The segmented compartment has section 14 to which a bracket 16 is joined, and section 18 to which a bracket 20 is joined. The two brackets are sized to overlap, and when in overlap position, have aligned openings 22*a* and 22*b*, and 24*a* and 24*b*.

Figure 6:
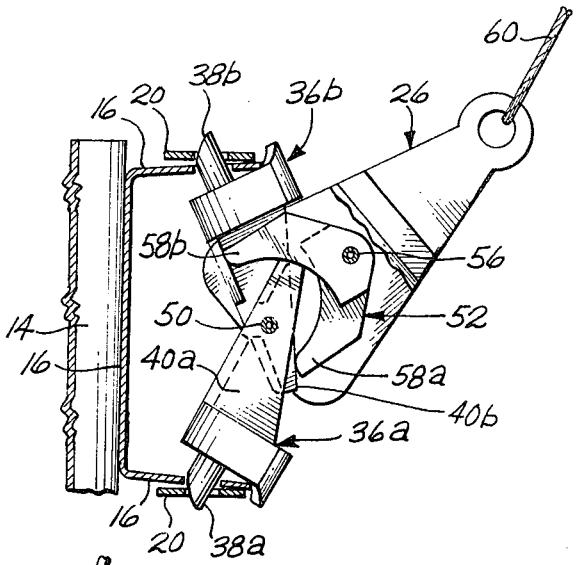
Figure 7:
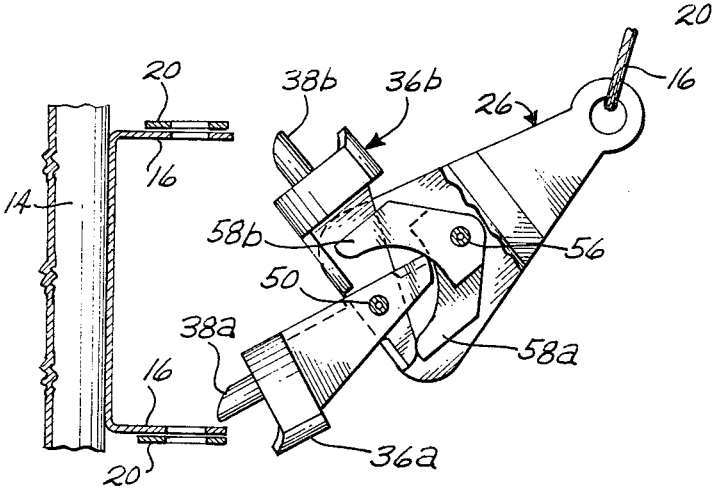
Figure 8:
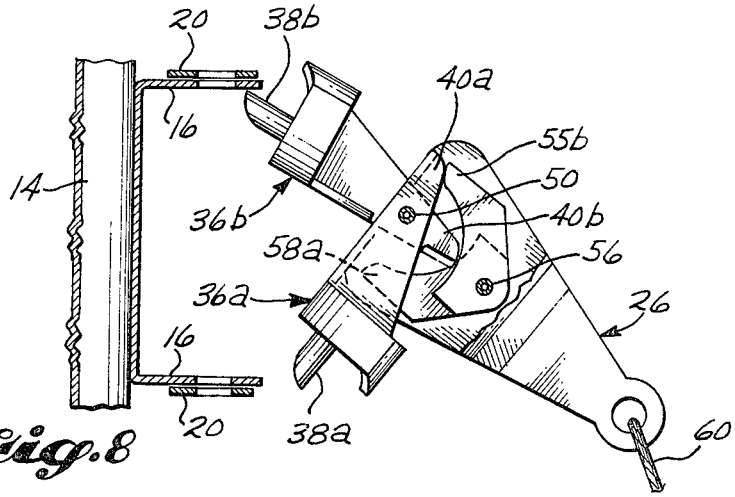
FIG. 8 shows the latch broken free as in FIG. 7 but in response to a force exerted from a different direction.

The directional release toggle latch has an elongated latch body 26 having an eyelet 28 at one end, and a clevis shape 30 at the other end. Two sets of holes 32*a* and 32*b*, and 34*a* and 34*b* are centrally located and are spaced apart, with holes 32*a* and 32*b* located near the open end of the clevis and holes 34*a* and 34*b* located near the base of the clevis. A pair of cooperating linkages or blocks 36*a* and 36*b*, each having appurtenances that will be designated a or b respectively, with each linkage or block having an outwardly extending latch or pin 38*a* or 38*b* and inwardly extending partially overlapping arm 40*a* or 40*b* that are preferably tapered along one side at 42*a* or 42*b*; have facing recesses near the end at 44*a* or 44*b*; have facing projections at 46*a* or 46*b* and have holes 48*a* or 48*b*. The linkages or blocks fit inside and near the end of the clevis shaped part 30 of the latch body 26; extend in a lateral or transverse direction, and are pivotally joined to the latch body with pin 50 that extends through holes 48*a* and 48*b* of the arms, and holes 32*a* and 32*b* of the clevis. When the blocks are pivotally joined, shoulder 46*a* mates into recess 44*b* and shoulder 46*b* mates into recess 44*a* to prevent the linkages or blocks from rotating toward the latch body. A U-shaped rocker arm 52 has a hole 54 located near the base and, pin 56 extends through that hole and also through holes 34*a* and 34*b* to pivotally mount the rocker arm inside the clevis section of the latch body. The rocker arm has off-set end extensions 58*a* and 58*b* so that 58*a* aligns with block arm 40*b* and 58*b* aligns with block arm 40*a*. A lanyard 60 is joined to the latch body through eyelet 28; provides a convenient means for applying pressure to open the latch and acts as a means for retaining the latch when it is pulled free from the brackets. When tension is applied to the latch body in a direction perpendicular to the laterally extending linkages, or within about 15 degrees in either direction from perpendicular, the extensions on the rocker arms contact the arms linkages and prevent rotation of those arms. When tension is applied at a larger angle from perpendicular, one of the extensions moves past the end of the arm on the linkage and permits that linkage to rotate away from the latch body to release the latch from the brackets. See FIGS. 6 and 7 for arm 40*a* moves past 58*b* of the rocker arm in response to a pull in one direction away from vertical and FIG. 8 where arm 40*b* moves past extension 58*a* in response to a pull in the other direction away from vertical.

In operation the two halves of the sectionalized compartment are closed, with openings in brackets aligned to permit insertion of the latch into the brackets to lock the section together. The latch body 26 is aligned at an angle at least 15 degrees from perpendicular with respect to the direction of the cooperating linkages 36*a* and 36*b* to permit one of the linkages to rotate away from the latch body. The pins 38*a* and 38*b* are inserted into the openings in the brackets; the latch body 26 pressed toward the compartment until the linkages are in line and the shoulders of the linkages are pressed against the brackets, at which position the latch body is rotated to an angle of less than about 15 degrees from perpendicular, to lock the latch in place. To release and remove the latch, tension is placed on the lanyard at an angle greater than 15 degrees from perpendicular.

I claim:

1. A directional release toggle latch comprising: a pair of cooperating blocks each having an outwardly extending pin and an inwardly extending arm, a yoke shaped latch body to which the arms of the blocks are pivotally connected, means for preventing the blocks from rotating toward the latch body, and means for preventing the blocks from rotating away from the latch body with said body aligned perpendicular to the outward extending pins while permitting such rotation with the latch body aligned at an angle from perpendicular.

2. A directional release toggle latch as in claim 1 wherein the latch body aligned at an angle in excess of about 15 degrees from perpendicular permits rotation of the blocks.

3. A directional release toggle latch as in claim 1 wherein the means for controlling block rotation away from the latch body comprises: a U-shaped rocker arm pivotally mounted within the body with ends of the rocker arm extending to contact the arms to the cooperating blocks with the latch body in the perpendicular position, and extending past one of the arms of the blocks with the latch body pivoted away from the perpendicular position.

4. A directional release toggle latch comprising: a pair of partially overlapping transverse linkages pivotally mounted to allow rotation in one direction with respect to each other with each linkage having a shoulder to butt against a bracket, and an integral outwardly extending pin to extend through an opening in the bracket; a longitudinal extending latch body having an end clevis shaped to extend outside of and to pin through the pivot point of the linkages; a U-shaped rocker arm pivotally mounted inside the latch body and extending to contact the ends of the overlapping linkages to prevent rotation of said linkages when a pulling force is applied to the latch body in a direction perpendicular to the laterally extending linkages and to move past the end of one of the linkages to permit rotation and removal of the latch from the brackets when a pulling force is applied to the latch body in a direction at an angle away from perpendicular.

5. A directional release toggle latch as in claim 4 wherein the pulling angle for release of the latch is at least about 15 degrees.

6. A directional release toggle latch for fastening together and for quickly releasing from interlocking brackets joining together a sectionalized compartment with the directional release toggle latch comprising; an elongated latch body having an eyelet for fastening to a lanyard on one end of the body and a clevis shaped opposite end; a pair of cooperating transverse linkages each having an outwardly extending shoulder to abut against a bracket, an integral outwardly extending pin to extend through openings in and to join together interlocking brackets, and inwardly extending partially overlapping arms; means for pivotally joining the overlapping arms to the clevis end of the latch body; means for limiting rotation of the block toward the latch body; and a U-shaped rocker arm pivotally mounted within the clevis shaped latch body with ends of the "U" directed to contact and stop rotation of the overlapping arm when tension from the lanyard is applied to the latch body in a direction perpendicular to or within a small angle on either side of perpendicular with respect to the transversely extending cooperating linkages, and to pass by one of the overlapping arms to permit rotation and complete removal of the toggle latch when the tension is applied at a greater angle from perpendicular.

7. A directional release toggle latch as in claim 6 wherein the "U" ends pass by the overlapping arm when the angle of tension exceeds more than about 15 degrees from perpendicular.

* * * * *